US012503275B2

(12) United States Patent
Baird

(10) Patent No.: US 12,503,275 B2
(45) Date of Patent: Dec. 23, 2025

(54) LID WITH DISPENSING FEATURE

(71) Applicant: Graphic Packaging International, LLC, Atlanta, GA (US)

(72) Inventor: Kyle Baird, Milwaukee, WI (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 18/772,729

(22) Filed: Jul. 15, 2024

(65) Prior Publication Data

US 2024/0367868 A1 Nov. 7, 2024

Related U.S. Application Data

(62) Division of application No. 16/547,884, filed on Aug. 22, 2019, now Pat. No. 12,065,288.

(60) Provisional application No. 62/721,569, filed on Aug. 22, 2018.

(51) Int. Cl.
*B65D 43/02* (2006.01)

(52) U.S. Cl.
CPC ..... *B65D 43/0212* (2013.01); *B65D 2543/00046* (2013.01); *B65D 2543/00092* (2013.01); *B65D 2543/00527* (2013.01); *B65D 2543/00537* (2013.01); *B65D 2543/00685* (2013.01)

(58) Field of Classification Search
CPC ..... B65D 43/0212; B65D 2543/00046; B65D 2543/00092; B65D 2543/00527; B65D 2543/00537; B65D 2543/00685; B65D 2543/00055; B65D 43/169; B65D 43/16; B65D 43/021; B65D 2251/0021; B65D 2251/0025; B65D 2251/0003; B65D 2251/0006; B65D 2251/0012; B65D 2251/0015; B65D 2251/0018; B65D 2251/0028; B65D 51/18
See application file for complete search history.

(56) References Cited

U.S. PATENT DOCUMENTS

| | | | |
|---|---|---|---|
| 3,355,058 | A | 11/1967 | Asbury |
| 3,362,569 | A | 1/1968 | Geiger |
| 3,797,696 | A | 3/1974 | Dirbell |
| 3,860,162 | A | 1/1975 | Schutz |
| 3,927,794 | A | 12/1975 | Erdman |

(Continued)

FOREIGN PATENT DOCUMENTS

| | | |
|---|---|---|
| CH | 712478 | 11/2017 |
| EP | 2295338 A1 | 3/2011 |

(Continued)

OTHER PUBLICATIONS

International Search Report and Written Opinion for PCT/US2019/047630 dated Dec. 13, 2019.

(Continued)

*Primary Examiner* — Jeffrey R Allen
(74) *Attorney, Agent, or Firm* — Andrew N. Claerbout; FisherBroyles, LLC

(57) ABSTRACT

A lid for a container. The lid can comprise a central wall and a dispensing feature comprising a dispenser flap foldably connected to the central wall, a projection extending from the dispenser flap, and a ledge. The dispenser flap can be movable to a dispensing position in which the dispenser flap is spaced from the ledge to at least partially form a dispensing opening. The projection can be in locking engagement with the ledge when the dispenser flap is in the dispensing position.

17 Claims, 8 Drawing Sheets

(56) References Cited

U.S. PATENT DOCUMENTS

| | | | |
|---|---|---|---|
| 4,056,210 | A | 11/1977 | Boyle |
| 4,081,103 | A | 3/1978 | Zoellick |
| 4,106,660 | A | 8/1978 | Boyle |
| 4,113,135 | A | 9/1978 | Yamazaki |
| 4,127,212 | A | 11/1978 | Waterbury |
| 4,138,033 | A | 2/1979 | Payne |
| 4,184,604 | A | 1/1980 | Amberg |
| 4,190,174 | A | 2/1980 | Haimowitz |
| 4,206,854 | A | 6/1980 | Takami |
| 4,210,256 | A | 7/1980 | Amberg et al. |
| 4,245,752 | A | 1/1981 | Prueher |
| 4,350,260 | A | 9/1982 | Prucher |
| 4,394,928 | A | 7/1983 | Philip |
| 4,412,629 | A | 11/1983 | Dart et al. |
| D271,945 | S | 12/1983 | Ochs |
| 4,463,866 | A | 8/1984 | Mandel |
| 4,582,214 | A | 4/1986 | Dart et al. |
| 4,615,459 | A | 10/1986 | Clements |
| D287,919 | S | 1/1987 | Clements |
| 4,717,037 | A | 1/1988 | van der Meulen |
| D299,010 | S | 12/1988 | Wall |
| 5,050,758 | A | 9/1991 | Freeman et al. |
| D338,621 | S | 8/1993 | Balson |
| D352,455 | S | 11/1994 | Balson |
| 5,490,609 | A | 2/1996 | Lane |
| D379,588 | S | 6/1997 | Pledger |
| D380,385 | S | 7/1997 | Litke |
| 5,678,720 | A | 10/1997 | Van Melle |
| 5,699,927 | A | 12/1997 | Lane et al. |
| 5,706,972 | A | 1/1998 | Sousa |
| 5,820,016 | A | 10/1998 | Stropkay |
| 5,839,601 | A | 11/1998 | Van Melle |
| 5,894,950 | A | 4/1999 | Kick |
| 5,897,019 | A | 4/1999 | Stropkay |
| 6,089,397 | A | 7/2000 | Van Melle |
| D447,412 | S | 9/2001 | Durdon |
| 6,523,712 | B1 | 2/2003 | McGushion |
| 6,612,456 | B1 | 9/2003 | Hundley et al. |
| D481,312 | S | 10/2003 | Martin |
| D481,633 | S | 11/2003 | Schmidtner |
| 6,644,490 | B2 | 11/2003 | Clarke |
| D517,322 | S | 3/2006 | Zettle |
| 7,111,749 | B1 | 9/2006 | Akers |
| D533,778 | S | 12/2006 | Hollis |
| D560,120 | S | 1/2008 | Maravich |
| D564,354 | S | 3/2008 | Maravich |
| D574,238 | S | 8/2008 | Walker |
| D585,279 | S | 1/2009 | Walker |
| D614,954 | S | 5/2010 | Crowell |
| D632,174 | S | 2/2011 | Charbonnet |
| D641,239 | S | 7/2011 | Ramsey |
| D641,622 | S | 7/2011 | Fields |
| D641,623 | S | 7/2011 | Fields |
| D643,718 | S | 8/2011 | Fields |
| D647,400 | S | 10/2011 | Fields |
| D649,049 | S | 11/2011 | Fields |
| D672,235 | S | 12/2012 | Chapin |
| D682,611 | S | 5/2013 | Carder |
| D687,144 | S | 7/2013 | Gronberg |
| D694,625 | S | 12/2013 | Maxwell |
| D696,113 | S | 12/2013 | Stein |
| D696,940 | S | 1/2014 | Hale |
| D703,044 | S | 4/2014 | Chou |
| 8,701,914 | B1 | 4/2014 | Buck |
| D704,053 | S | 5/2014 | Kim |
| D709,366 | S | 7/2014 | Fleming |
| 8,789,718 | B1 | 7/2014 | Daniel |
| D716,141 | S | 10/2014 | Rush |
| D721,584 | S | 1/2015 | Koennecke |
| D722,498 | S | 2/2015 | Fleming |
| D722,873 | S | 2/2015 | Wu |
| 9,238,529 | B1 | 1/2016 | Newman |
| D749,889 | S | 2/2016 | Magistro |
| D752,975 | S | 4/2016 | Gatto |
| 9,364,107 | B2 | 6/2016 | Bolek |
| D761,104 | S | 7/2016 | Buck |
| 9,394,087 | B2 | 7/2016 | Phillips |
| D767,391 | S | 9/2016 | Buck |
| 9,452,867 | B2 | 9/2016 | Koestring |
| D776,529 | S | 1/2017 | Torrison |
| 9,751,665 | B2 | 9/2017 | Fleming |
| 9,814,334 | B2 | 11/2017 | Eickhoff |
| D828,160 | S | 9/2018 | Biard et al. |
| D834,419 | S | 11/2018 | Baird et al. |
| 10,729,262 | B2 | 8/2020 | Fleming |
| 10,940,979 | B1 | 3/2021 | Gillespie |
| 2003/0218017 | A1 | 11/2003 | Schmidtner et al. |
| 2005/0109780 | A1 | 5/2005 | Pendergrass |
| 2006/0071008 | A1 | 4/2006 | Sadlier |
| 2006/0096983 | A1 | 5/2006 | Patterson |
| 2006/0226147 | A1 | 10/2006 | Phillips |
| 2006/0255037 | A1 | 11/2006 | Hollis |
| 2007/0095832 | A1 | 5/2007 | Hollis |
| 2008/0185383 | A1 | 8/2008 | Philippe |
| 2008/0245792 | A1 | 10/2008 | Chou |
| 2009/0008391 | A1 | 1/2009 | Bjorkholm |
| 2009/0032543 | A1 | 2/2009 | Lee |
| 2009/0266828 | A1 | 10/2009 | Cai |
| 2009/0294460 | A1 | 12/2009 | Hovsepian |
| 2010/0133272 | A1 | 6/2010 | Whitaker |
| 2010/0264143 | A1 | 10/2010 | Chrisman |
| 2010/0288769 | A1 | 11/2010 | Cheng |
| 2011/0062158 | A1 | 3/2011 | Hung |
| 2011/0233209 | A1 | 9/2011 | Tu |
| 2011/0284564 | A1 | 11/2011 | Hsieh |
| 2012/0048856 | A1 | 3/2012 | Walker |
| 2012/0097690 | A1 | 4/2012 | Chien |
| 2012/0152968 | A1 | 6/2012 | Bailey |
| 2013/0240546 | A1 | 9/2013 | Chen |
| 2013/0320018 | A1 | 12/2013 | Crosby |
| 2014/0284344 | A1 | 9/2014 | French |
| 2015/0021345 | A1 | 1/2015 | Wu |
| 2015/0076151 | A1 | 3/2015 | Knipe |
| 2015/0196149 | A1 | 7/2015 | Savenok |
| 2016/0007780 | A1 | 1/2016 | Dolan |
| 2016/0058223 | A1 | 3/2016 | Savenok |
| 2016/0325883 | A1 | 11/2016 | Wu |
| 2016/0325890 | A1 | 11/2016 | Hong |
| 2017/0238740 | A1 | 8/2017 | Steiert |
| 2017/0369214 | A1 | 12/2017 | Seidler |
| 2018/0134465 | A1 | 5/2018 | Kuo |
| 2019/0367228 | A1 | 12/2019 | Wang |
| 2021/0047083 | A1 | 2/2021 | Eickhoff |
| 2022/0097925 | A1 | 3/2022 | Baird |

FOREIGN PATENT DOCUMENTS

| | | | |
|---|---|---|---|
| EP | 2639180 | A1 | 9/2013 |
| JP | D1243010 | | 6/2005 |
| JP | 2007-290717 | A | 11/2007 |
| KR | 10-2010-0109627 | A | 10/2010 |
| KR | 10-1014806 | B1 | 2/2011 |
| KR | 300613814.0000 | | 9/2011 |
| WO | WO 2006/036327 | A2 | 4/2006 |

OTHER PUBLICATIONS

Supplementary European Search Report for EP 19 85 3235 dated Apr. 14, 2022.

Solo Hot Cups: Announced Mar. 15, 2011 [online], site visited [Aug. 17, 2017]. Available from Internet URL: https://www.uline.com/BL_6563/Hot-Cups.

Uline Paper Hot Cups: announced Jul. 5, 2014 [online], site visited [Aug. 17, 2017]. Available from Internet URL: https://www.uline.com/BL_540/Paper-Hot-Cups.

Choice 10 ox. Paper Hot cup Lid: site visited Aug. 17, 2017. Available from Internet URL: https://www.webstaurantstore.com/choice-10-oz-paper-hot-cup-lid-andleev-e-combo-kit-pack/99910CAFE25.html.

Fee(s) Transmittal for U.S. Appl. No. 16/547,884 dated Jul. 16, 2024.

Notice of Allowance and Fee(s) Due for U.S. Appl. No. 16/547,884 dated Apr. 22, 2024.

(56) References Cited

OTHER PUBLICATIONS

Decision on Appeal for U.S. Appl. No. 16/547,884 dated Apr. 8, 2024.
Reply Brief for U.S. Appl. No. 16/547,884 dated Feb. 8, 2023.
Examiner's Answer for U.S. Appl. No. 16/547,884 dated Dec. 9, 2022.
Appeal Brief for U.S. Appl. No. 16/547,884 dated Oct. 12, 2022.
Notice of Panel Decision from Pre-Appeal Brief Review for U.S. Appl. No. 16/547,884 dated Sep. 13, 2022.
Pre-Appeal Brief Request for Review for U.S. Appl. No. 16/547,884 dated Aug. 8, 2022.
Notice of Appeal for U.S. Appl. No. 16/547,884 dated Aug. 8, 2022.
Office Action for U.S. Appl. No. 16/547,884 dated May 10, 2022.
Amendment B and Response to Office Action for U.S. Appl. No. 16/547,884 dated Mar. 8, 2022.
Office Action for U.S. Appl. No. 16/547,884 dated Dec. 16, 2021.
Amendment A and Response to Office Action for U.S. Appl. No. 16/547,884 dated Sep. 23, 2021.
Office Action for U.S. Appl. No. 16/547,884 dated Jun. 24, 2021.
Response to Restriction Requirement for U.S. Appl. No. 16/547,884 dated Apr. 21, 2021.
Office Action for U.S. Appl. No. 16/547,884 dated Mar. 9, 2021.

LID WITH DISPENSING FEATURE

CROSS-REFERENCE TO RELATED APPLICATIONS

This application is a divisional of U.S. patent application Ser. No. 16/547,884, filed on Aug. 22, 2019, which claims the benefit of U.S. Provisional Patent Application No. 62/721,569, filed on Aug. 22, 2018.

INCORPORATION BY REFERENCE

The disclosures of U.S. patent application Ser. No. 16/547,884, filed Aug. 22, 2019, and U.S. Provisional Patent Application No. 62/721,569, filed Aug. 22, 2018, are hereby incorporated by reference for all purposes as if presented herein in their entirety.

BACKGROUND OF THE DISCLOSURE

The present disclosure relates to lids for containers (e.g., beverage cups) for containing and/or dispensing fluids (e.g., beverages). More specifically, the disclosure is generally directed to a lid having a dispensing feature.

SUMMARY OF THE DISCLOSURE

In general, one aspect of the disclosure is generally directed to a lid for a container. The lid can comprise a central wall and a dispensing feature comprising a dispenser flap foldably connected to the central wall, a projection extending from the dispenser flap, and a ledge. The dispenser flap can be movable to a dispensing position in which the dispenser flap is spaced from the ledge to at least partially form a dispensing opening. The projection can be in locking engagement with the ledge when the dispenser flap is in the dispensing position.

In another aspect, the disclosure is generally directed to a method of forming a lid. The method can comprise forming a central wall and forming a dispensing feature comprising a dispenser flap foldably connected to the central wall, a projection extending from the dispenser flap, and a ledge. The dispenser flap can be movable to a dispensing position in which the dispenser flap is spaced from the ledge to at least partially form a dispensing opening. The projection can be in locking engagement with the ledge when the dispenser flap is in the dispensing position.

In another aspect, the disclosure is generally directed to a method that can comprise obtaining a lid comprising a central wall and a dispensing feature. The dispensing feature can comprise a dispenser flap foldably connected to the central wall, a projection extending from the dispenser flap, and a ledge. The method further can comprise actuating the dispensing feature by moving the dispenser flap to a dispensing position in which the dispenser flap is spaced from the ledge to at least partially form a dispensing opening and locking the dispensing feature in the dispensing position by engaging the projection in locking engagement with the ledge.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Containers and lids according to the present disclosure can cooperate to accommodate fluids, e.g., liquid or semi-liquid beverages that can include one or more solid components, of different sizes and compositions. For the purpose of illustration and not for the purpose of limiting the scope of the disclosure, the following detailed description describes a container for cool, cold, and/or at least partially frozen beverages, e.g., water, soda, iced coffee, cold brew coffee, blended ice beverages (such as smoothies, slush beverages, milkshakes, etc.), iced tea, lemonade, and other flavored or unflavored beverages, to name a few. It will be understood that the containers and lids described herein can contain different types of beverages having any suitable temperature and/or products containing one or more food items without departing from the disclosure.

As described herein, lids can be formed of a plastic material (e.g., a food grade polymer) and containers can be formed from blanks (e.g., paperboard blanks). In one embodiment, lids can be formed by thermoforming and/or injection molding and/or any other suitable forming method. Containers can be formed from the blanks by overlapping multiple portions, panels, and/or end flaps. Such portions, panels, and/or end flaps may be designated herein in terms relative to one another, e.g., "first," "second," "third," etc., in sequential or non-sequential reference, without departing from the disclosure. In another embodiment, the lids could be formed from paper products and/or the containers could be formed from plastic materials without departing from the disclosure. In this specification, the terms "inner," "interior," "outer," "exterior," "front," "back," "rear," "side," "lower,"

"bottom," "upper," and "top" indicate orientations determined in relation to fully erected and upright containers.

Figure 1:
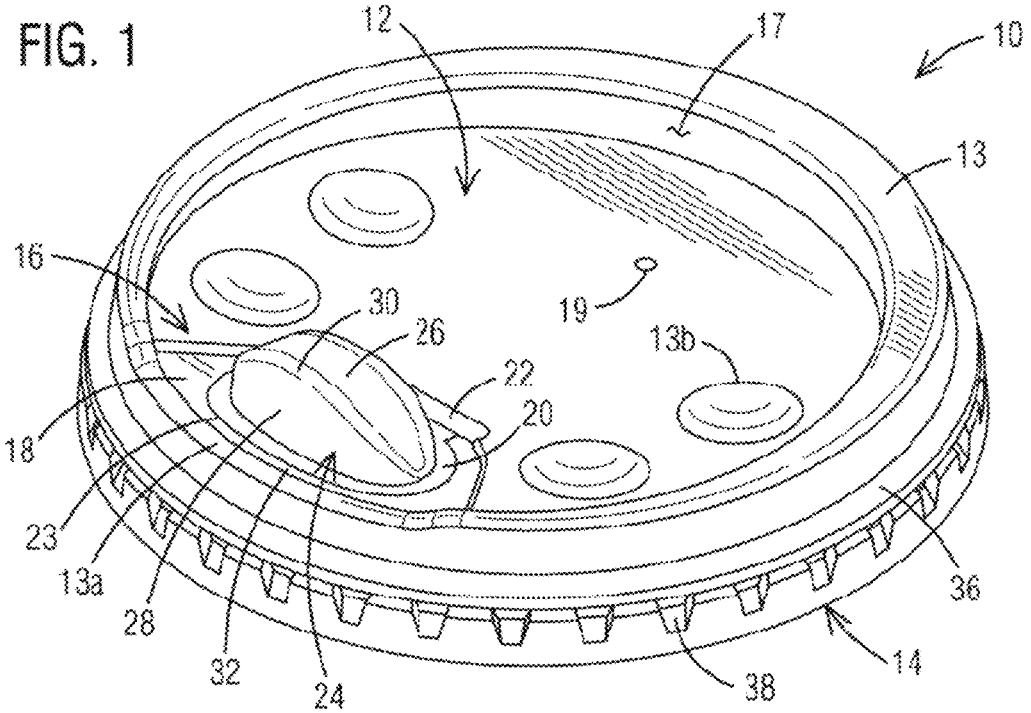
FIG. 1 is a perspective view of a lid with a dispensing feature in an initial configuration according to a first exemplary embodiment of the disclosure.

In an exemplary embodiment, FIG. 1 illustrates a drinking lid 10 for attachment to a container C (FIGS. 6, 7, and 9), such as a drinking cup. The container C can be configured for holding cold and/or hot beverages and/or other suitable items. In one embodiment, the container can hold cold beverages (e.g., soda, juice, milk, tea, coffee, cocktails, and/or other suitable beverages) with or without ice. In another embodiment, the container can hold hot beverages (e.g., tea, coffee, hot chocolate, and/or other suitable beverages). The container can have a bottom wall B (FIG. 7) and a sidewall SW (FIGS. 6, 7, and 9) extending around an interior of the container for holding the beverage or any suitable liquid L. The container further can include a rim R (FIGS. 7 and 9) for receiving the lid at a top end of the sidewall SW.

Figure 2:
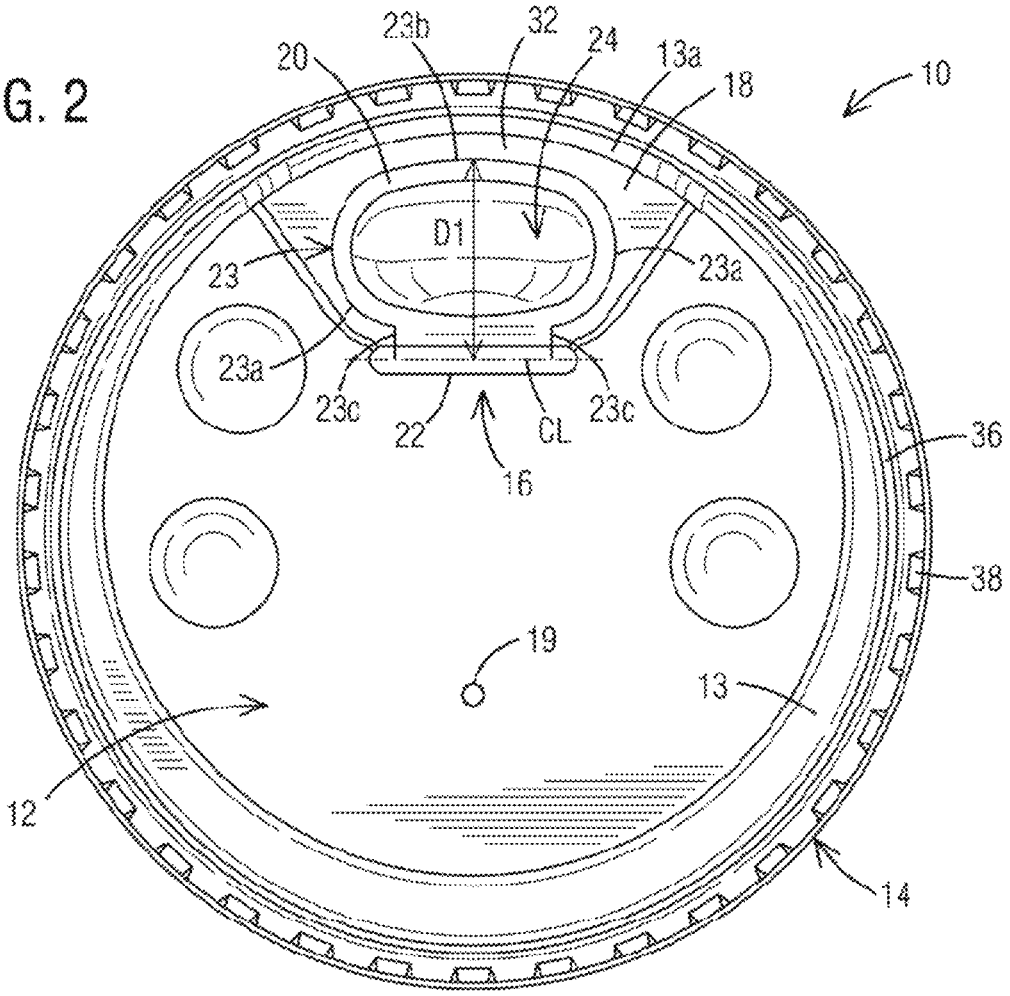
FIG. 2 is a bottom plan view of the lid of FIG. 1.
Figure 3:
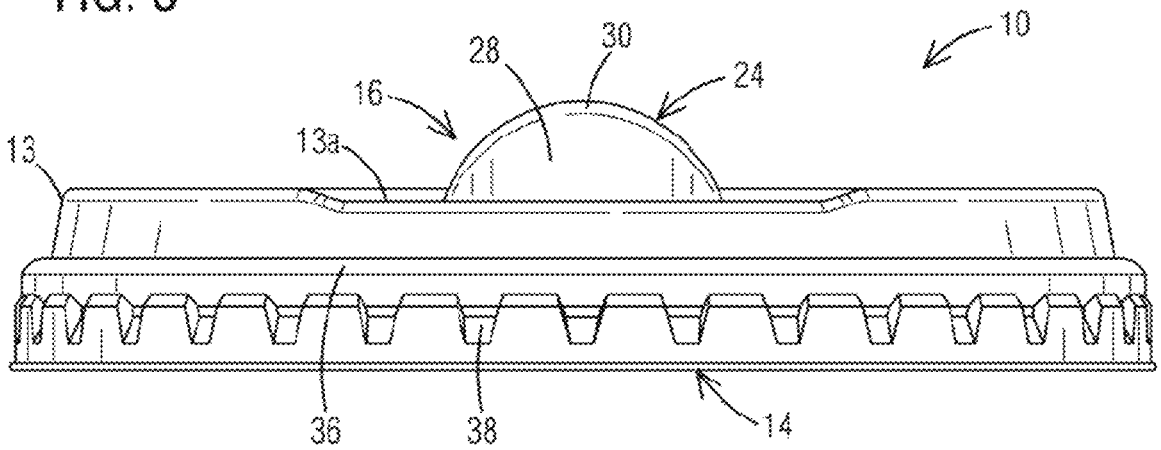
FIGS. 3 and 4 are elevation views of the lid of FIG. 1.
Figure 4:
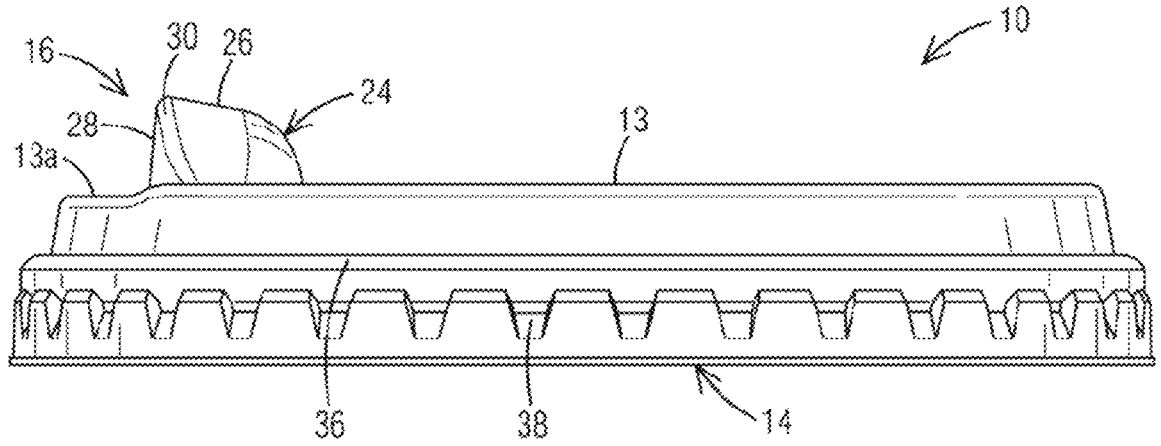
Figure 5:
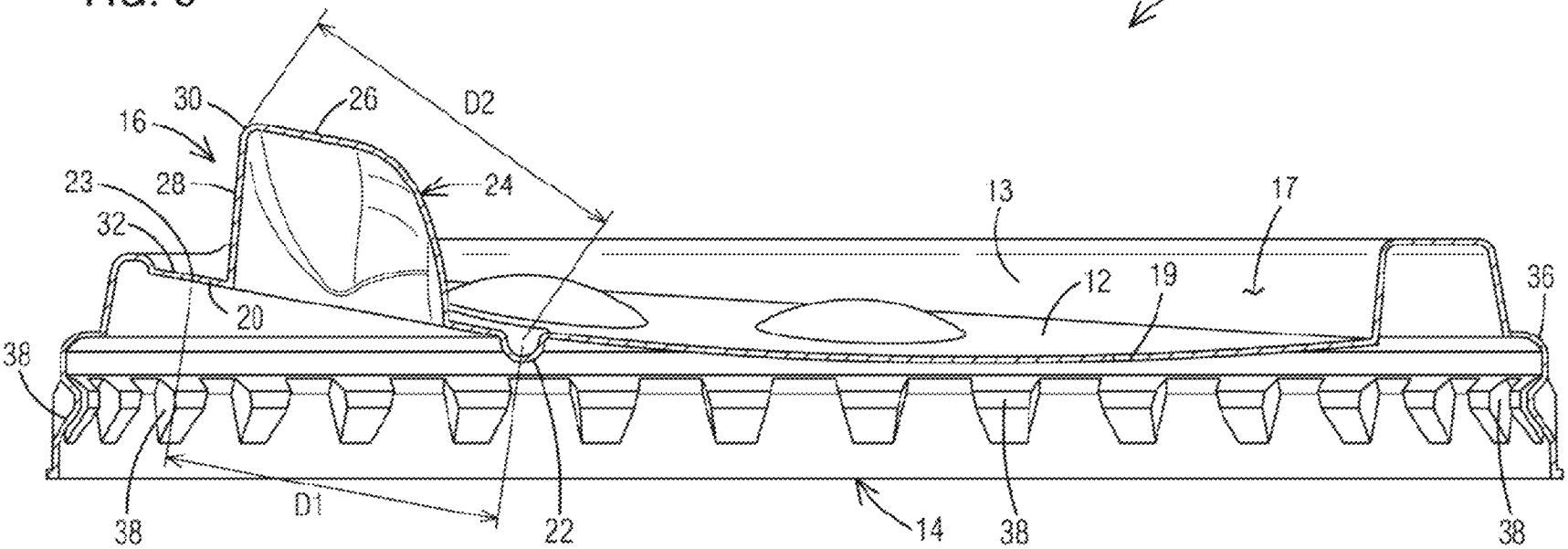
FIG. 5 is a cross-sectional view of the lid of FIG. 1.

As shown in FIGS. 1-5, the lid 10 can include a top or central wall 12, an annular ridge 13 extending upwardly from the central wall 12, a flange or annular skirt 14 extending downwardly from the central wall 12 and the annular ridge 13, and an opening feature or dispensing feature 16 formed in the central wall 12. As shown in FIGS. 1 and 5, the central wall 12 can be sloped downwardly from the dispensing feature 16 and the central wall 12 and the annular ridge 13 can form an interior space or ponding area 17 so that any liquid on the top side of the lid 10 can collect in an area that is spaced away from the dispensing feature 16. As shown in FIGS. 1, 3, and 4, the annular ridge 13 can include a recessed portion 13*a* that extends along at least a portion of the dispensing feature 16. In the illustrated embodiment, the central wall 12 also can include indicators 13*b* that can be selectively actuated (e.g., depressed) or marked to indicate the type of beverage that is contained in the container C. As shown in FIGS. 1, 2, and 5, the central wall 12 optionally can include a vent 19, which can allow gases (e.g., from carbonated beverages) to escape from the interior of the container C and/or can allow air to enter the interior when liquid L is being dispensed through the dispensing feature 16. In one embodiment, the vent 19 can be positioned in or near a lowest point of the central wall 12 (e.g., so that the central wall 12 slopes upwardly from the vent 19 to the annular ridge 13). Alternatively, the vent 19 could be omitted. The central wall 12 and/or the annular ridge 13 could be omitted or could be otherwise shaped, arranged, positioned, and/or configured without departing from the disclosure.

In the illustrated embodiment, the dispensing feature 16 can include a recessed panel 18 extending from the central wall 12 and a dispenser flap 20 foldably connected to the top panel 12 along a hinge 22. As shown in FIGS. 1, 2, and 5, the dispenser flap 20 can be separable from the recessed panel 18 along a cut 23. In one embodiment, the cut 23 could be any line of weakness (e.g., a partial cut, perforation line, tear line, a cut line with one or more nicks, etc.) that is suitable for allowing the dispenser flap 20 to separate from the recessed panel 18 when the dispensing feature 16 is actuated. As shown in FIGS. 1-5, the opening feature 16 further can include a projection or protuberance 24 with a curved top surface 26, a front surface 28, and a corner 30 extending between the top surface 26 and the front surface 28. In an exemplary embodiment, the dispenser flap 20 and the protuberance 24 can be considered a tab. As shown in FIGS. 1, 2, and 5, the protuberance 24 is spaced from the cut 23 in the dispenser flap 20 so that a portion of the dispenser flap 20 extends around the perimeter of the protuberance 24. In the illustrated embodiment, the top surface 26 can be curved as shown in at least FIGS. 1 and 3 to allow fluid to flow efficiently around the protuberance 24 as described in more detail below. In addition, the curve and slope of the top surface 26 shown in FIGS. 1-5 can help provide a more comfortable engagement between the protuberance 24 and a user's lip. In the illustrated embodiment, the top surface 26 can be curved from a central portion of the protuberance 24 to respective sides of the protuberance 24 in a direction that is parallel to the front surface 28 and the ledge 32 (FIG. 3). In addition, the top surface 26 can be curved downwardly away from the front surface 28 in an exemplary embodiment (FIG. 4). The dispenser flap 20 and/or the protuberance 24 could be omitted or could be otherwise shaped, arranged, positioned, and/or configured without departing from the disclosure.

As shown in FIGS. 1 and 5, the hinge 22 can be a curved (e.g., semicircular) portion extending downwardly relative to the central wall 12 and the recessed panel 18 and can extend from the recessed panel 18 to the central wall 12. In one embodiment, as shown in FIG. 2, the cut 23 can include two curved (e.g., semicircular) side portions 23*a* extending from a front portion 23*b*, which can be curved (e.g., slightly curved). In the illustrated embodiment, two end portions 23*c* of the cut 23 can extend from respective ends of the side portions 23*a* to a centerline CL of the hinge 22. In one embodiment, the end portions 23*c* are straight in the plan view of FIG. 2; however, the end portions 23*c* extend along the curve of the hinge 22 from the recessed panel 18 to the centerline CL. Alternatively, the cut 23, including any of its portions 23*a*, 23*b*, 23*c*, could have any suitable shape without departing from the disclosure. As shown in FIGS. 1, 2, and 5, the front portion 23*b* of the cut 23 can be spaced from the recessed portion 13*a* of the annular ridge 13 so that the recessed panel 18 forms a ledge 32 extending from the recessed portion 13*a* to the front portion 23*b*.

As shown in FIGS. 2 and 5, the front portion 23*b* of the cut 23, and the edges of the dispenser flap 20 and the ledge 32 formed along the front portion 23*b*, can be spaced from the centerline CL of the hinge 22 by a distance D1. In one embodiment, a center point of the front portion 23*b* is spaced from the centerline CL by the distance D1 or the maximum distance between the front portion 23*b* and the centerline CL is the distance D1. Alternatively, the front portion 23*b* could be straight so that the entire front portion 23*b* is spaced from the centerline CL by the distance D1. As shown in FIG. 5, the corner 30 of the protuberance 24 is spaced apart from the centerline CL of the hinge 22 by a distance D2 (e.g., the center point and/or the maximum distance between the corner 30 and the centerline CL is the distance D2). In the illustrated embodiment, the distance D2 is greater than the distance D1 so that protuberance 24 and the ledge 32 can engage one another to lock the dispensing feature in the dispensing position as discussed in more detail below.

As shown in FIGS. 1-5, the dispensing feature 16 is in a closed configuration wherein the dispenser flap 20 engages, abuts, and/or is closely spaced from the recessed panel 18 at the cut 23 to help prevent or reduce spilling or splashing of liquids in the container C through the dispensing feature 16 when the dispensing feature 16 is in the closed position of FIGS. 1-5. The dispensing feature 16 could be otherwise shaped, arranged, positioned, and/or configured without departing from the disclosure.

Figure 6:
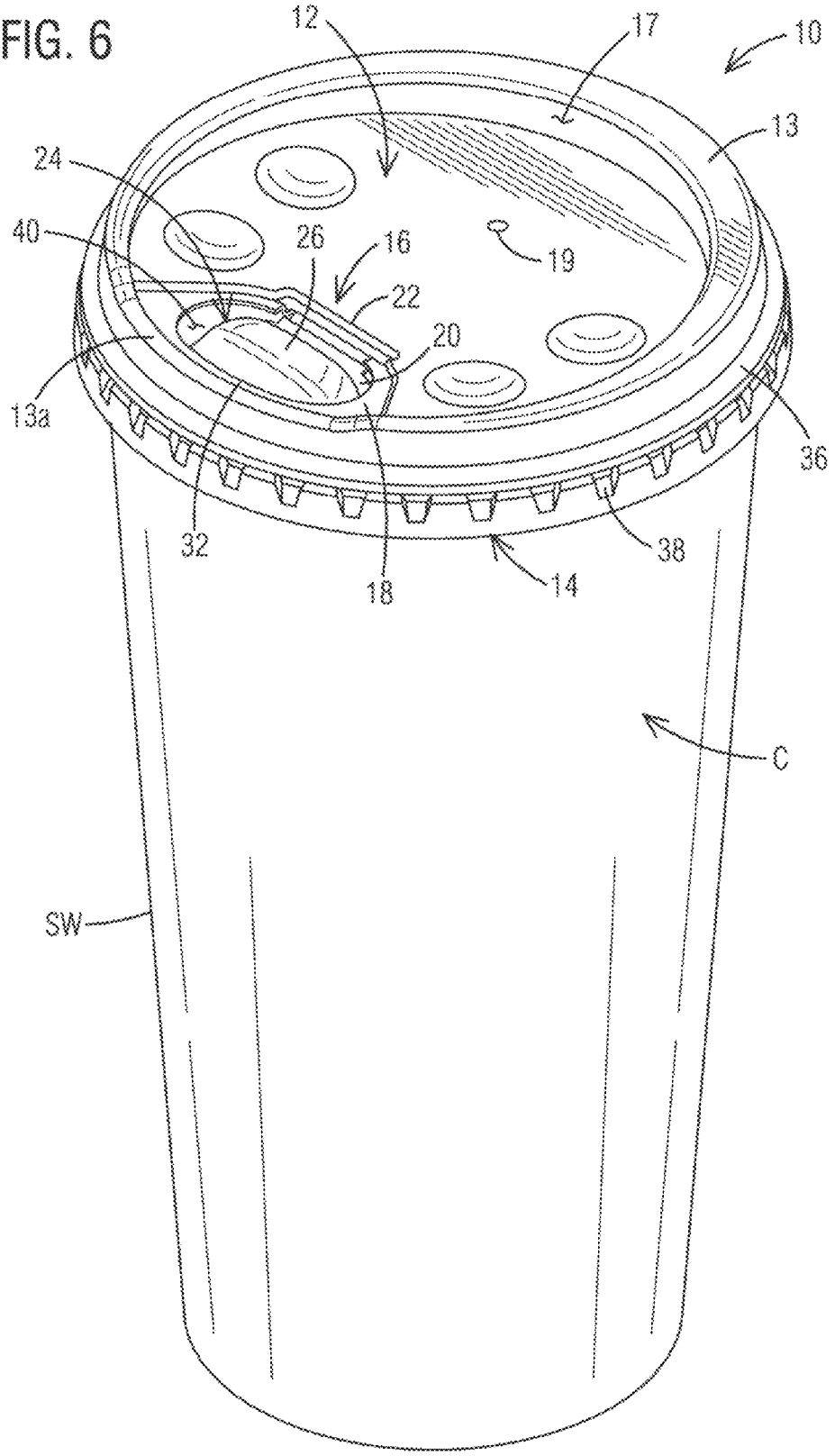
FIG. 6 is a perspective view of the lid of FIG. 1 engaged with a container and with the dispensing feature in a dispensing configuration according to the first exemplary embodiment of the disclosure.
Figure 7:
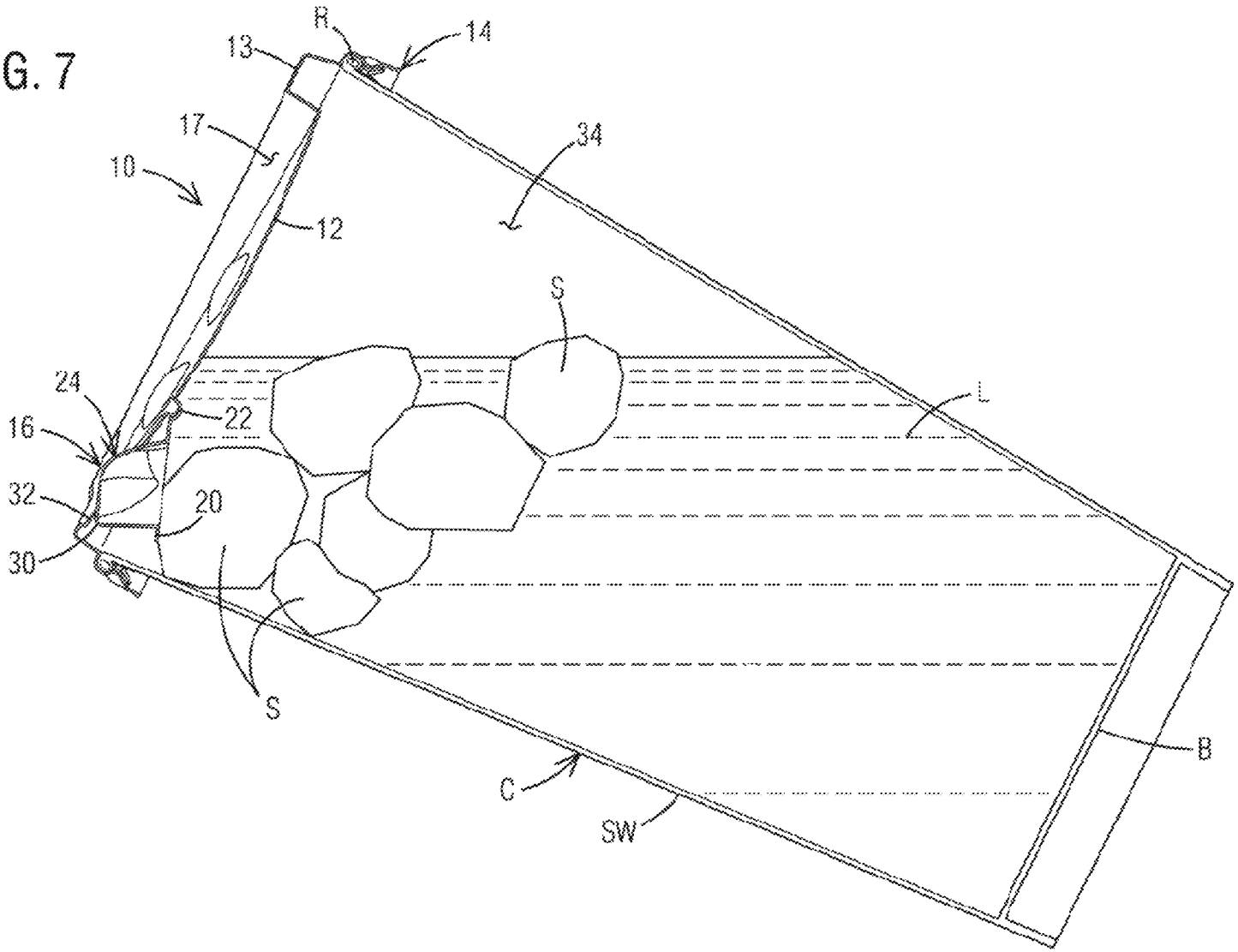
FIG. 7 is a cross-sectional view of the lid and container of FIG. 6 with a liquid and solids in the interior defined by the container and the lid according to the first embodiment of the disclosure.
Figure 8:
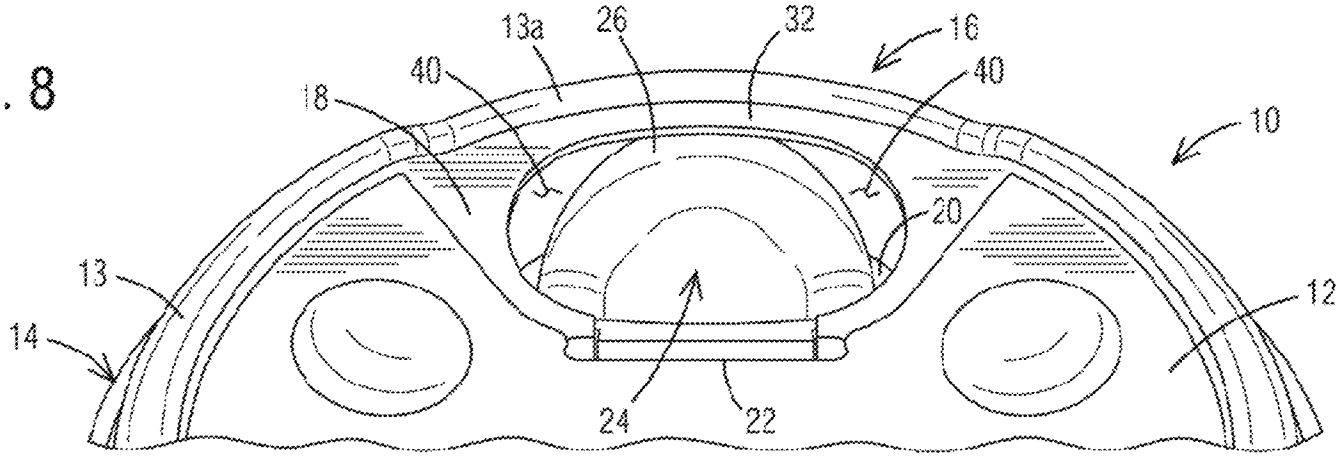
FIG. 8 is a partial perspective view of the lid of FIGS. 1 and 6 with the dispensing feature in the dispensing configuration according to the first embodiment of the disclosure.
Figure 9:
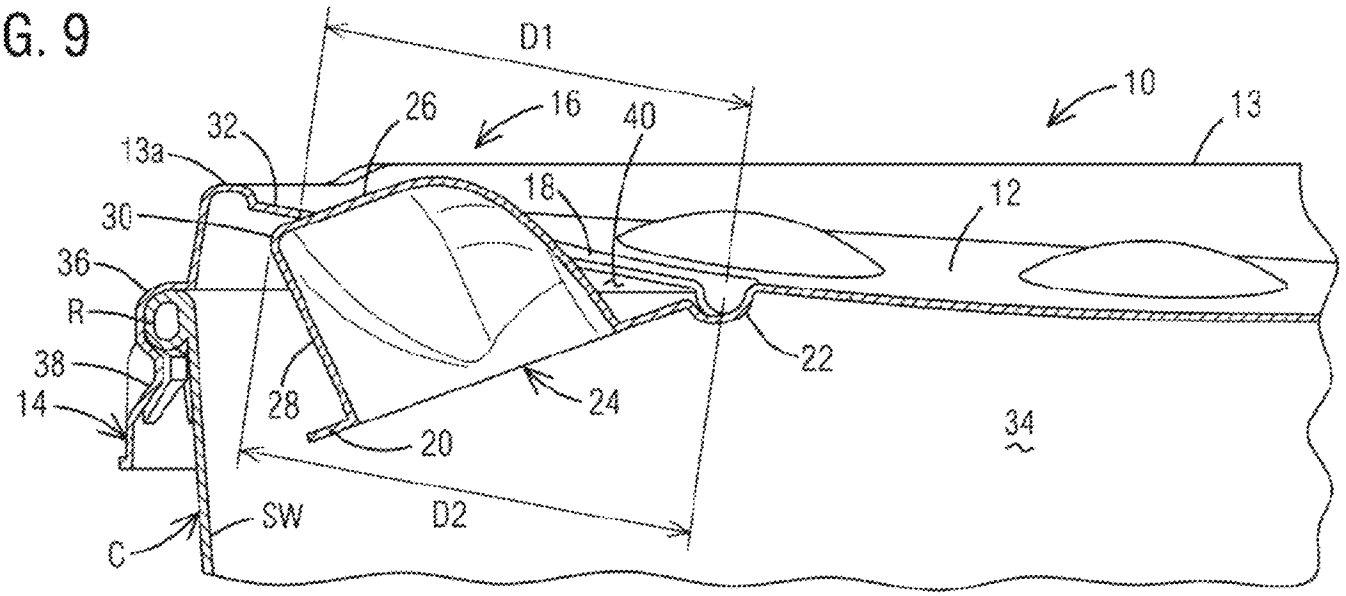
FIG. 9 is a detail cross-sectional view of the lid and the container of FIGS. 6 and 7.

As shown in FIG. 6, the lid 10 can engage the container C so that the container C and the lid 10 cooperate to enclose an interior space 34 (FIGS. 7 and 9). In the illustrated embodiment, the skirt 14 includes an internal annular groove 36 extending along the annular ridge 13 and a plurality of inwardly-extending protrusions 38 spaced along the circumference of the skirt 14. As shown in FIG. 5, the protrusions 38 have upper surfaces that form a lower portion of the annular groove 36, and the upper surfaces of the protrusions 38 can be curved and/or sloped. When the lid 10 is engaged with the container C to at least partially close the top end of the container C, the lid 10 can be placed over the rim R of the container C so that the skirt 14 engages the rim R. The lid 10 can be pressed downwardly onto the container C so that sloped lower surfaces of the protrusions 38 engage the rim R. In one embodiment, the downward pressure on the lid 10 can cause the rim R to push outwardly on the sloped surfaces of the protrusions 38, causing the skirt 14 to pivot (e.g., bend, flex, and/or fold) outwardly so that the protrusions 38 can move past the rim R as the lid 10 is pushed downwardly. Accordingly, as shown in FIGS. 7 and 9, the lid 10 can snap onto the rim R as the protrusions 38 move past the rim R and the rim R is engaged in the annular groove 36. The skirt 14 can move back to its original position with the protrusions 38 engaged with an underside of the rim R at their upper surfaces (FIGS. 7 and 9). The snap-fit engagement of the rim R with the annular groove 36 and the protrusions 38 can help retain the lid 10 in engagement with the container C so that purposeful bending force can be required on the skirt 14 to remove the lid 10. The skirt 14 could be omitted or could be otherwise shaped, arranged, positioned, and/or configured without departing from the disclosure. For example, the lid 10 could be otherwise configured to engage the container C.

As shown in FIGS. 6-9, the dispensing feature 16 can be actuated to an open or dispensing configuration (e.g., for drinking a beverage through the opening feature). In one embodiment, the dispensing feature 16 can be actuated by pressing against a portion (e.g., the top surface 26) of the protuberance 24 (e.g., with a finger or an upper lip) so that the protuberance 24 and the dispenser flap 20 are pushed downwardly (e.g., inwardly) about the hinge 22. When the protuberance 24 and the dispenser flap 20 are pressed downwardly, the dispenser flap 20 can separate from the recessed panel 18 at the cut 23 and can pivot about the hinge 22 (e.g., along the centerline CL). At least a portion of the front surface 28 of the protuberance 24 can slide against the ledge 32 of the recessed panel 18 until the corner 30 snaps under the ledge 32 and the top surface 26 engages under the ledge 32 (FIGS. 7 and 9). As the protuberance 32 slides past the edge of the recessed panel 18 formed by the cut 23 at the ledge 32, at least the ledge 32 can deform to accommodate the corner 30, which is spaced farther from the centerline CL than the edge of the ledge 32 (e.g., the distance D2 is greater than the distance D1 as shown in FIG. 9). Once the corner 30 passes the ledge 32, the ledge can snap back to its original position to engage the upper surface 26 of the protuberance 24. The engagement (e.g., locking engagement) of the ledge 32 with the upper surface 26 adjacent the corner 30 can help retain the protuberance 24 and the dispenser flap 20 in the inward, dispensing position of FIGS. 6-9. Accordingly, the protuberance 24 and the dispenser flap 20 can be locked in the open configuration so that they are retained in the open dispensing configuration. In one embodiment, the dispensing feature 16 can be locked permanently in the open configuration or can require significant effort to close the dispensing feature 16 (e.g., by removing the lid 10 from the container C and forcing the lid 10 to deform so that the protuberance 24 can move past the ledge 32 of the recessed panel 18).

As shown in FIGS. 6-9, an opening 40 can be formed in the dispensing feature 16 when the dispenser flap 20 is moved to the dispensing position and the protuberance 24 is in locking engagement with the ledge 32. The opening 40 can be formed around the protuberance 24 and the dispenser flap 20 when the dispensing feature 16 is in the dispensing configuration. In the illustrated embodiment, the liquid L can flow around the dispenser flap 20 and the protuberance 24 (e.g., along the curved top surface 26) through the opening 40 when a user tilts the container for drinking the beverage (FIG. 7). In one embodiment, the curve of the top surface 26 results in the sides of the protuberance 24 (e.g., the portions of the protuberance 24 adjacent the side portions 23*a* of the cut 23) being shorter than the central portion of the protuberance 24 at the front surface 28 (e.g., where the protuberance 24 engages the ledge 32 in the dispensing position) so that the liquid L can easily flow around the sides of the protuberance 24 through the opening 40. As shown in FIG. 7, solids S (e.g., ice, fruit pieces, tea bags, infusers, etc.) can be blocked by the dispenser flap 20 and/or the protuberance 24 while the liquid L is dispensed through the opening 40. Accordingly, the solids S are at least partially prevented from passing through the opening 40, blocking the opening 40, and/or contacting a drinker's lips and/or teeth while the liquid L is dispensed so that it is easier, more comfortable, and/or more convenient for the user to drink the beverage. The dispensing feature 16 could be otherwise shaped, arranged, positioned, and/or configured without departing from the disclosure.

In operation, a user can at least partially fill the container C with liquid L and/or solids S and can engage the lid 10 with the top portion of the container C. As shown in FIGS. 6, 7, and 9, the lid 10 can be pressed downwardly on the top of the container C with the skirt 14 on an outside portion of the rim R until the rim R snaps into the annular groove 36. The protrusions 38 can engage under the rim R to help retain the lid 10 on the container C. In the illustrated embodiment, the dispenser flap 20 in the closed position of FIGS. 1-5 can help prevent splashing and/or spilling of the liquid L from the container C. The user can actuate the dispensing feature 16 by pressing downwardly on the protuberance 24 (e.g., by engaging the top surface 26 with a lip or a finger) until the corner 30 of the protuberance 24 snaps under the ledge 32 so that the dispenser flap 20 is in a dispensing position and the protuberance 24 is in locking engagement with the ledge 32. In one example, a user can press down on the protuberance 24 with their lip while taking an initial drink from the container C through the lid 10. As shown in FIGS. 6-9, the opening 40 formed around the dispenser flap 20 and the protuberance 24 can allow the liquid L to pass through the dispensing feature 16 while the protuberance 24 and the dispenser flap 20 can at least partially block the solids S away from the opening 40. In one embodiment, the user can increase the flow rate of the liquid through the dispensing feature 16 by pressing on the protuberance 24 (e.g., with the user's lip while drinking) to move the dispenser flap 20 and the protuberance 24 inwardly about the hinge 22 to increase the size of the opening 40.

Figure 10:
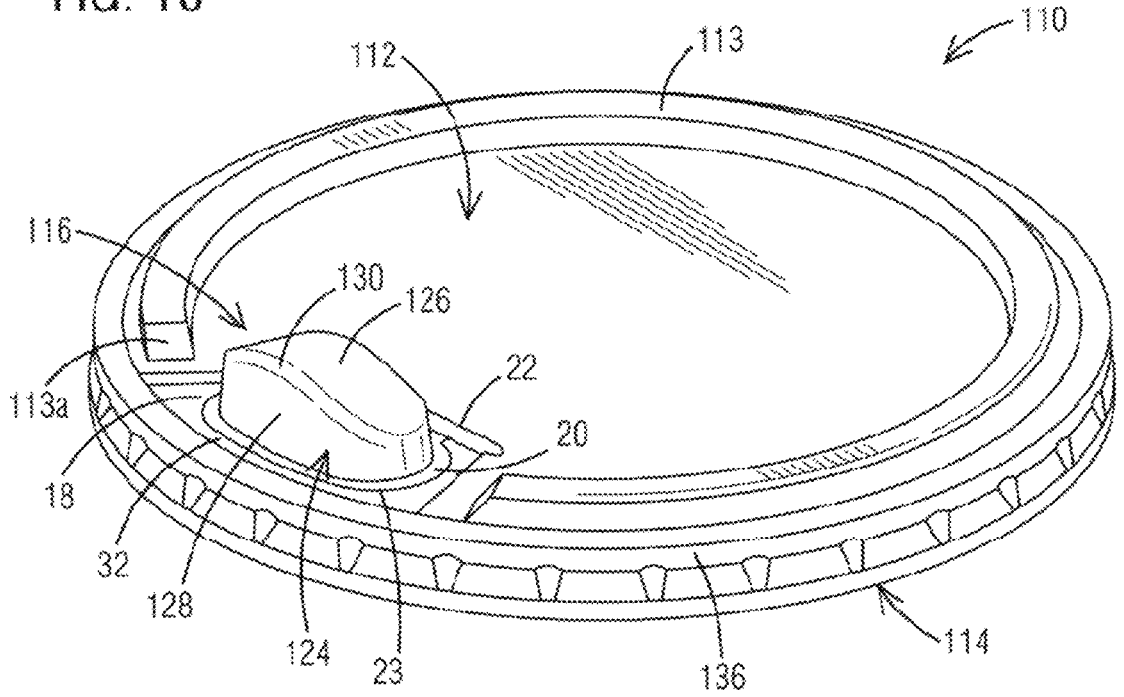
FIG. 10 is a perspective view of a lid with a dispensing feature in an initial configuration according to a second exemplary embodiment of the disclosure.
Figure 11:
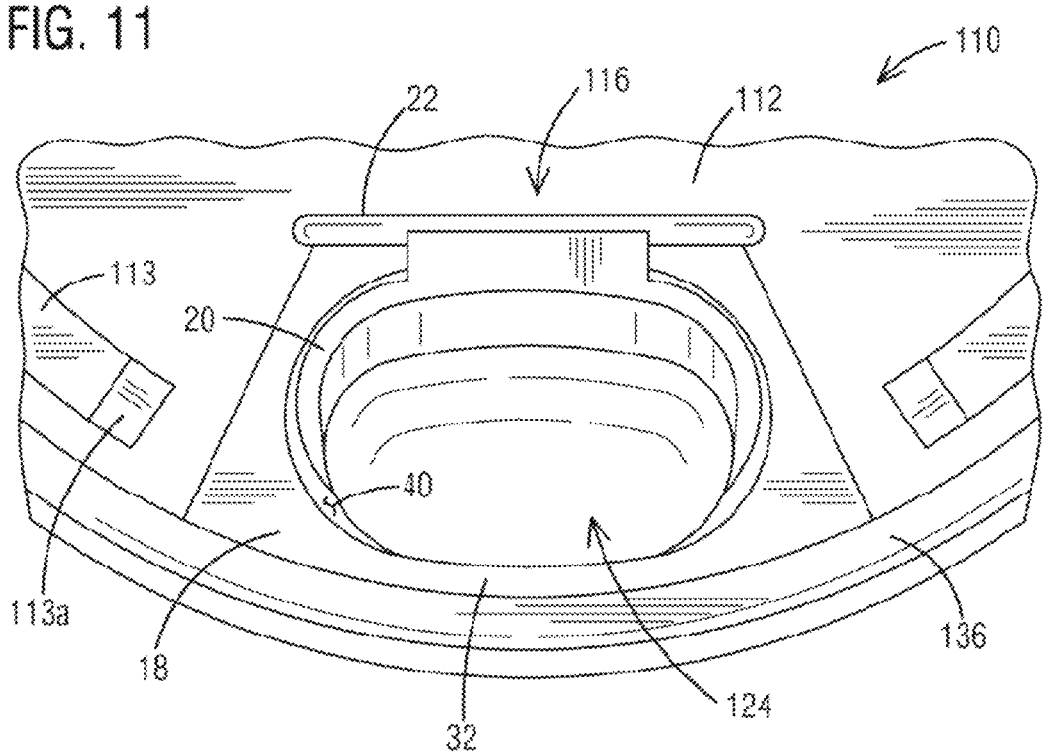
FIG. 11 is a partial perspective view of the lid of FIG. 10 with the dispensing feature in a dispensing configuration according to the second embodiment of the disclosure.

FIG. 10 is a perspective view of a lid 110 of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 10, the lid 110 includes an annular ridge 113 that is spaced from the outer edge of the central wall 112 and the annular groove 136 forms an outer ridge along the outer circumference of the central wall 112. In one embodiment, the annular ridge 113 and the annular groove 136 can be structural elements that can help prevent unwanted bending of the lid 110 and/or can help retain small amounts of liquid on top of the lid 110. As shown in FIGS. 10 and 11, the annular ridge 113 can include a gap 113*a* to accommodate the dispensing feature 116. In the illustrated embodiment, the central wall 112 does not include the vent 19 or the indicators 13*b* of the lid 10 as shown in FIG. 1. The central wall 112 and/or the annular ridge 113 could be omitted or could be otherwise shaped, arranged, positioned, and/or configured without departing from the disclosure. For example, the central wall 112 of the lid 110 could include the indicators 13*b*, the vent 19, and/or other suitable features.

Figure 12:
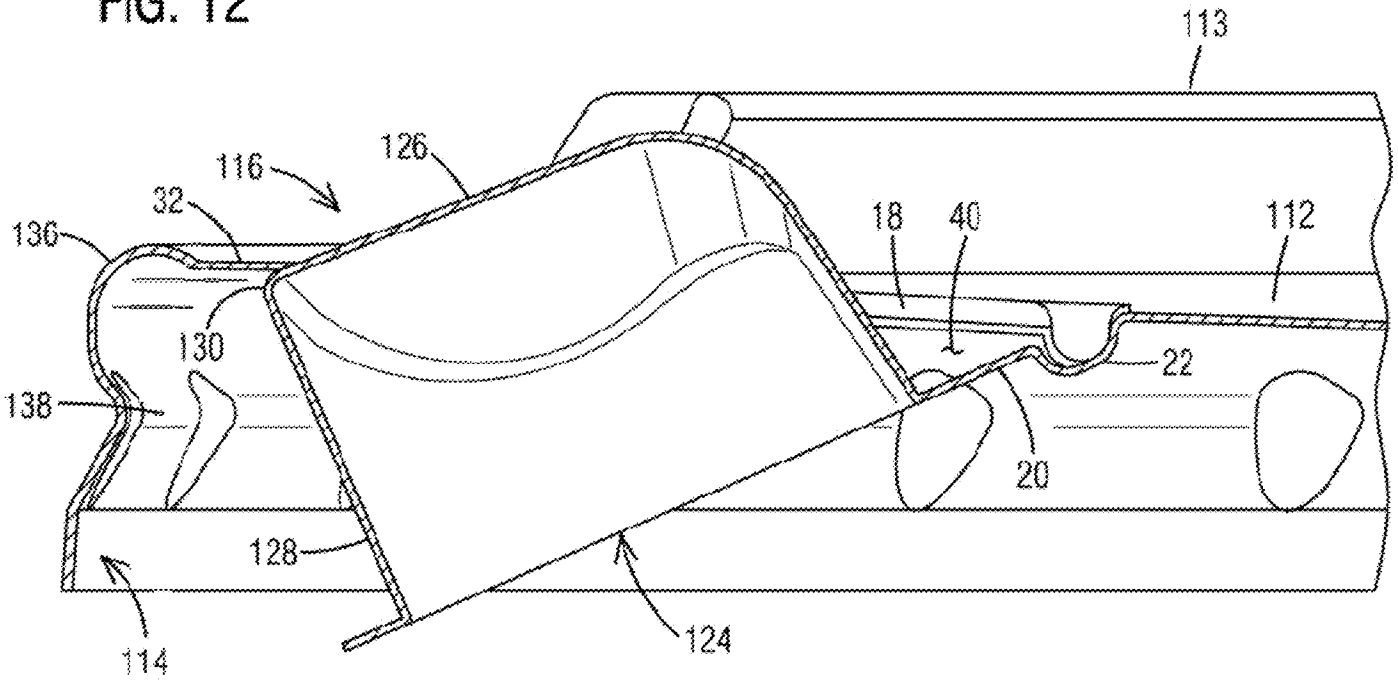
FIG. 12 is a detail cross-sectional view of the lid of FIG. 11.

As shown in FIG. 10, the dispensing feature 116 includes a projection or protuberance 124 with a top surface 126, a front surface 128, and a corner 130 that has a different shape than the protuberance 24 of the first embodiment. The dispensing feature 116 can be actuated similarly to the dispensing feature 16 of the first embodiment with the dispenser flap 20 folded downwardly along the hinge 22 away from the ledge 32 so that the top surface 126 can be in locking engagement with the ledge 32 with the corner 130 positioned below the ledge 32 (FIGS. 11 and 12). The dispensing feature 116 could be otherwise shaped, arranged, positioned, and/or configured without departing from the disclosure.

As shown in FIGS. 10 and 12, the lid 110 can include a skirt 114 that cooperates with the annular groove 136 and a retention feature 138 to engage a container C in a similar manner as the skirt 14, the annular groove 36, and the protrusions 38 of the first embodiment. For example, the lid 110 can be placed over the rim R of the container C with the skirt 114 outside of the rim R and the lid 110 can be pressed downwardly so that the rim R snaps past the retention feature 138 and into the annular groove 136. In one embodiment, the retention feature 138 can engage under the rim R to help retain the lid 110 on the container C. Any of the skirt 114, the annular groove 138, and/or the retention feature 138 could be omitted or could be otherwise shaped, arranged, positioned, and/or configured without departing from the disclosure.

Any of the features of the various embodiments of the disclosure can be combined with, replaced by, or otherwise configured with other features of other embodiments of the disclosure without departing from the scope of this disclosure.

In one embodiment, the dispensing features 16, 116 can provide a more natural drinking experience for a user by providing a high flow rate of the beverage while keeping ice and/or other solids away from the opening 40. Accordingly, it can be convenient to drink a beverage from a container C with one of the lids 10, 110 without requiring a straw. For example, the dispensing features 16, 116 can help keep ice away from the user's lips and/or teeth so that the user is not bothered by the cold ice and/or so that the ice or other solids S do not impede the flow of the liquid L through the opening 40. In addition, the dispensing features 16, 116 can help prevent solids S (e.g., ice, fruit, tea bags, etc.) from unexpectedly passing through the opening 40 while a user is drinking in one embodiment. In an exemplary embodiment, the shape of the protrusions 24, 124 can allow a user to actuate the dispensing features 16, 116 (e.g., move the dispenser flap 20 to the dispensing position) by pressing the protrusion 24, 124 downwardly with their lip while taking an initial drink through the lid 10, 110 for a hands-free or one-handed operation. Additionally, in one embodiment, the locking of the dispensing features 16, 116 in the dispensing position can be more comfortable and convenient to use since the user does not need to continually push against the dispensing features 16, 116 to keep them open. A user can press against the protrusion 24, 124 (e.g., with their lip during drinking) to increase fluid flow through the opening 40, however. In the illustrated embodiments, the locking engagement of the dispensing features 16, 116 with the ledge 32 can keep the opening 40 from being closed so that gases (e.g., from a carbonated beverage) can be vented through the dispensing features 16, 116 without requiring a separate vent opening. However, an optional vent 19 can be included as shown in the first embodiment.

The containers and/or the blanks that form the containers according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the container to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

The above embodiments may be described as having one or more portions adhered together by glue during erection of the container embodiments. The term "glue" is intended to encompass all manner of adhesives commonly used to secure containers in place.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A method of forming a lid comprising:

forming a central wall; and forming a dispensing feature comprising a dispenser flap foldably connected to the central wall, a projection extending from the dispenser flap, and a ledge, wherein the projection comprises a top surface that is curved downwardly from a centerline of the projection along a direction that is parallel to at least a portion of the ledge;

the dispenser flap is movable to a dispensing position in which the dispenser flap is spaced from the ledge to at least partially form a dispensing opening, the projection being in locking engagement with the ledge when the dispenser flap is in the dispensing position.

2. The method of claim 1, wherein the projection comprises a front surface extending at least upwardly from the dispenser flap to a corner of the projection, and the corner is positioned below the ledge when the projection is in locking engagement with the ledge.

3. The method of claim 2, wherein the top surface extends from the corner, and the top surface engages the ledge when the projection is in locking engagement with the ledge.

4. The method of claim 2, wherein the dispenser flap is foldably connected to the central wall by at least a hinge, the ledge is spaced apart from the hinge by a first distance, the corner of the projection is spaced apart from the hinge by a second distance, and the second distance is greater than the first distance.

5. The method of claim 1, wherein the forming the central wall comprises forming a recessed panel extending in the central wall and that is recessed with respect to the central wall, the recessed panel comprising the ledge.

6. The method of claim 5, wherein the forming the dispensing feature comprises forming a cut in the recessed panel, the dispenser flap being separable from the recessed panel along the cut when the dispensing feature is in an initial position.

7. The method of claim 6, wherein the cut comprises two semicircular side portions and a front portion extending from respective ends of the side portions, the front portion extending along at least the ledge when the dispensing feature is in the initial position.

8. The method of claim 7, wherein the dispenser flap is foldably connected to the central wall along a hinge, and the cut further comprises two end portions extending from respective ends of the side portions and into the hinge.

9. The method of claim 1, wherein the top surface engages the ledge when the projection is in locking engagement with the ledge.

10. The method of claim 1, wherein the dispenser flap is foldably connected to the central wall by at least a hinge, the ledge is spaced apart from the hinge by a first distance, at least a portion of the projection is spaced apart from the hinge by a second distance, and the second distance is greater than the first distance.

11. A method comprising:

obtaining a lid comprising a central wall and a dispensing feature, the dispensing feature comprising a dispenser flap foldably connected to the central wall, a projection extending from the dispenser flap, and a ledge, wherein the projection comprises a top surface that is curved downwardly from a centerline of the projection along a direction that is parallel to at least a portion of the ledge;

actuating the dispensing feature by moving the dispenser flap to a dispensing position in which the dispenser flap is spaced from the ledge to at least partially form a dispensing opening; and locking the dispensing feature in the dispensing position by engaging the projection in locking engagement with the ledge.

12. The method of claim 11, wherein the projection comprises a front surface extending at least upwardly from the dispenser flap to a corner of the projection, and the engaging the projection in locking engagement with the ledge comprises positioning the corner below the ledge.

13. The method of claim 12, wherein the top surface extends from the corner, and the engaging the projection in locking engagement with the ledge comprises engaging the top surface with the ledge.

14. The method of claim 11, further comprising a recessed panel extending in the central wall, wherein the recessed panel is recessed with respect to the central wall, and the recessed panel comprises the ledge.

15. The method of claim 14, wherein the dispenser flap is separable from the recessed panel along a cut prior to the actuating the dispensing feature.

16. The method of claim 11, wherein the engaging the projection in locking engagement with the ledge comprises engaging the top surface with the ledge.

17. The method of claim 11, wherein the dispenser flap is foldably connected to the central wall by at least a hinge, the ledge is spaced apart from the hinge by a first distance, at least a portion of the projection is spaced apart from the hinge by a second distance, and the second distance is greater than the first distance.

* * * * *